US005355802A

United States Patent [19]

Petitjean

[11] Patent Number: 5,355,802

[45] Date of Patent: Oct. 18, 1994

[54] METHOD AND APPARATUS FOR PERFORATING AND FRACTURING IN A BOREHOLE

[75] Inventor: Luc Petitjean, Danbury, Conn.

[73] Assignee: Schlumberger Technology Corporation, Ridgefield, Conn.

[21] Appl. No.: 975,497

[22] Filed: Nov. 10, 1992

[51] Int. Cl.[5] ..... F42B 3/00

[52] U.S. Cl. ..... 102/313; 102/312; 299/13

[58] Field of Search ..... 102/312, 313; 299/13

[56] References Cited

U.S. PATENT DOCUMENTS

| | | | |
|---|---|---|---|
| 2,660,716 | 11/1953 | McFarland | 340/15 |
| 3,422,760 | 1/1969 | Mohaupt | 102/21.6 |
| 3,687,075 | 8/1972 | Fritz | 102/23 |
| 4,039,030 | 7/1983 | Godfrey et al. | 166/299 |
| 4,164,886 | 8/1979 | Hallmark | 89/1 C |
| 4,391,337 | 7/1983 | Ford et al. | 175/4.6 |
| 4,498,391 | 2/1985 | Gergo et al. | 102/312 |
| 4,633,951 | 1/1987 | Hill et al. | 166/308 |
| 4,683,943 | 8/1987 | Hill et al. | 166/63 |
| 4,718,493 | 1/1988 | Hill et al. | 166/308 |
| 4,823,875 | 4/1989 | Hill | 166/280 |
| 5,101,900 | 4/1992 | Dees | 166/250 |
| 5,131,472 | 7/1992 | Dees et al. | 166/308 |
| 5,253,585 | 10/1993 | Hudak et al. | 102/311 |

*Primary Examiner*—Peter A. Nelson

*Attorney, Agent, or Firm*—Leonard W. Pojunas; Marc D. Foodman

[57] ABSTRACT

A method and apparatus for perforating a formation surrounding a wellbore and initiating and propagating a fracture in that formation to stimulate hydrocarbon production from the wellbore. The technique uses a perforation and propellant loading device which perforates and fractures in a single operation to greatly increase the efficiency over current perforation techniques. Efficiency is increased by a number of factors including firing the perforating shaped charge through a gas zone, reducing the overall perforation damage to the formation, increasing operation speed, and increasing pressure in the area of the borehole surrounding the production zone before perforation and propagation are initiated. In accordance with the invention, the timing of the propellant ignition and charge detonation are critical to achieve the desired results.

16 Claims, 2 Drawing Sheets

METHOD AND APPARATUS FOR PERFORATING AND FRACTURING IN A BOREHOLE

BACKGROUND OF THE INVENTION

The present invention relates generally to production of hydrocarbons from a borehole. More particularly, the present invention is a method and apparatus for perforating and fracturing a formation surrounding a borehole and propagating that fracture to increase hydrocarbon production from the borehole.

Techniques for perforating and fracturing a formation surrounding a borehole are known in the art. The most common technique for perforating and fracturing a formation to stimulate production includes the steps of: 1) penetrating a production zone with a projectile; and 2) hydraulically pressurizing the borehole to expand or propagate the fractures initiated by the projectile. This technique proves to be extremely expensive due to the preparation required for pressurizing a portion of a borehole. Typically, pressure around a production zone in the borehole is increased by pumping fluids into that portion of the well to obtain the high pressures necessary to expand the fracture in the production zones. This operation is generally time intensive and costly making these techniques unattractive for either multiple zone wells or wells with a low rate of production.

Other less expensive techniques using gas propellants have been implemented in place of hydraulic fracture propagation. The resulting procedure is similar to that discussed above. First, a projectile is fired to penetrate the production zone. Second, a propellant device is ignited to pressurize the zone of interest and propagate the fracture.

Godfrey et al., U.S. Pat. No. 4,039,030, describes a method using a propellant to maintain the pressure caused by a high explosive charge over a longer period. The high explosives are used to generate fractures while the role of the propellant is to extend these fractures. In accordance with this technique, the casing must be perforated prior to ignition of the high explosives and propellant as the high explosives are used exclusively to fracture the formation but not to perforate the casing.

Ford et al., U.S. Pat. No. 4,391,337, describes an integrated perforation and fracturing device in which a high velocity penetrating jet is instantaneously followed by a high pressure gas propellant. In essence, a tool including propellant gas generating materials and shaped charges is positioned in a desired zone in the borehole. The penetrating shaped charges and propellant material are ignited simultaneously. The high pressure propellant material amplifies and propagates the fractures initiated by the shaped charges.

Dees et al., U.S. Pat. No. 5,131,472, is an overbalance perforating and stimulation method which employs conveyed tubing to pressurize a portion of the borehole. Liquid is pumped downhole until the pressure in the tubing reaches a pressure above the fracture pressure of the formation. A perforating gun is then fired to perforate the casing. After the pressure has dropped, pumping of liquid downhole is resumed to open the fractures initiated by the perforation gun.

In Hill, U.S. Pat. No. 4,823,875, the well casing is filled with a compressible hydraulic fracturing fluid comprising a mixture of liquid, compressed gas, and proppant material. The pressure is raised to about 1000 psi greater than the fracture extension pressure of the zone to be fractured by pumping fluid downhole. The gas generating units are simultaneously ignited to generate combustion gasses and perforate the well casing. The perforated zone is fractured by the rapid outflow of an initial charge of sand-free combustion gas at the compression pressure followed by a charge of fracturing fluid laden with proppant material and then a second charge of combustion gas.

Although the prior art suggests downhole generators for use in fracturing operations, these techniques have not proven attractive from an economical or technical point of view. In conventional hydraulic fracturing, even with the use of downhole propellant gas generators, a substantial amount of hydraulic power capability must be maintained at the surface. None of the techniques have provided an economical process for perforating and fracturing as part of a single highly efficient operation.

SUMMARY OF THE INVENTION

The present invention provides a method and apparatus for perforating and fracturing a formation surrounding a borehole and propagating that fracture to increase the efficiency of hydrocarbon production in the borehole. The invention is advantageous because it benefits from the energy of the shaped charges to perforate and initiate fractures in the formation. In addition, it provides better propagation of the fractures. The greater efficiency is achieved by pressurizing a section of the borehole using gas propellant materials which release gas into the borehole prior to the firing of the shaped charges. No hydraulic pumping capabilities are necessary.

According to one aspect of the invention, a tool including a propellant material and shaped charges is positioned in a production zone of the borehole. The propellant is ignited releasing gas into the borehole. The gas pressurizes the portion of the borehole surrounding the production zone. A predetermined time period is permitted to elapse during which the borehole reaches a maximum pressure level and decreases a preselected amount. Then, shaped charges are fired. Due to the precise timing delay for firing the shaped charges, a desired pressure level is achieved in the production zone. The pressure level must be significantly above the breakdown pressure of the formation. To maximize the efficiency of the technique in a cased hole, the pressure level must be just below the maximum that can be applied to the casing.

Once the shaped charges are fired, they create a perforation tunnel and help to initiate fractures at particular locations in the borehole. These fractures are propagated more quickly and penetrate deeper than the procedures of previously known techniques. Increased efficiency is achieved at the initial fracturing as well as greater fracture speed. This is due in part to the firing of the shaped charges through a gas zone instead of through liquid. The invention also provides less propellant loss during the pressurizing step because of the precise timing between ignition of the gas propellant material and the firing of the shaped charges.

In another embodiment of the invention, the shaped charges are designed to accomplish a dual purpose. First, the shaped charges perforate the casing. Second, after passing through the casing they continue into the formation initiating a fracture. In fact, the invention provides even better results in a cased hole because the casing reduces the amount of propellant which leaks into the formation.

This embodiment of the invention provides superior results to those obtained by the prior art because unlike the prior art, the pressure in the borehole is maximized at the time the shaped charges are fired. Another aspect of the invention which allows it to obtain superior results is that perforation of the casing and initiation of the fracture are accomplished in a single step upon firing of the shaped charges. The efficiency of the invention is improved because the propellant does not leak through the perforation during a time lag between perforation and initiation of the fracture. Further, high explosives as described by Godfrey et al., which can crush the formation and which cannot be oriented with precision, are eliminated from the procedure. Instead, precise shaped charges having focused penetration points are used. A further understanding of the nature and advantages of the invention may be realized by reference to the remaining portions of the specification and the drawings.

DESCRIPTION OF THE PREFERRED EMBODIMENT

Figure 1:
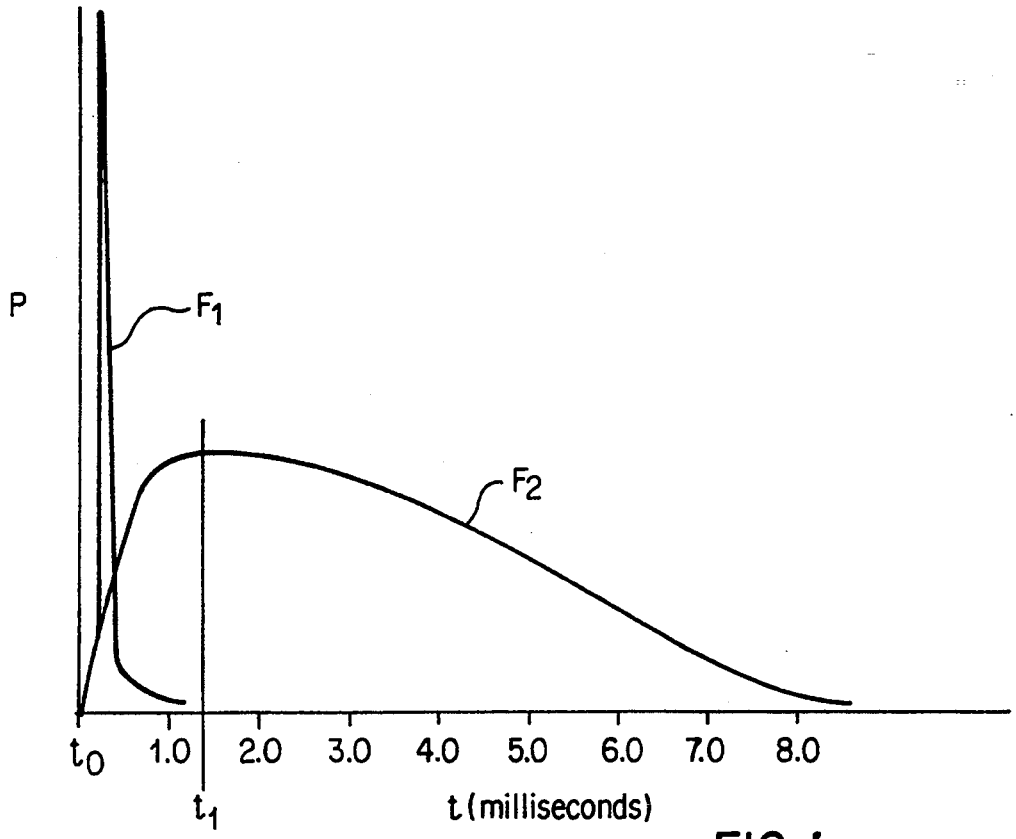
FIG. 1 PRIOR ART
FIG. 1 is a diagram illustrating the pressures achieved by a propellant material and a penetrating jet as a function of time in the prior art.

FIG. 1 is an illustration of a timing diagram in accordance with a prior art technique for fracturing a borehole wall for well production. Ford et al. represents a prior art technique in accordance with the timing diagram of FIG. 1. In FIG. 1, spiked function $F_1$ represents a schematic of the pressure vs. time curve of the shock-front pressure of the penetrating jet. This curve rises very quickly from its inception at time $t_0$, and then falls as quickly as it rose. The entire time period for the detonation and its associated pressure rise and fall is approximately 0.1 milliseconds.

Function $F_2$ represents the time vs. pressure curve generated in the borehole by the ignition of a propellant material which is designed to initiate a fracture in the formation surrounding a borehole. As seen from FIG. 1, the propellant, which is also ignited at time $t_0$, reaches its peak pressure at time $t_1$ long after the maximum pressure created by the explosive charge has subsided. As seen from this diagram, the explosive which is used to fracture the rock operates independently of the propellant which initiates propagation of a fracture. In accordance with prior techniques, the propellant gas leaks through the perforated portion of the casing before the pressure reaches a level allowing fracture initiation and propagation at a time close to $t_1$ (See FIG. 1).

Figure 2:
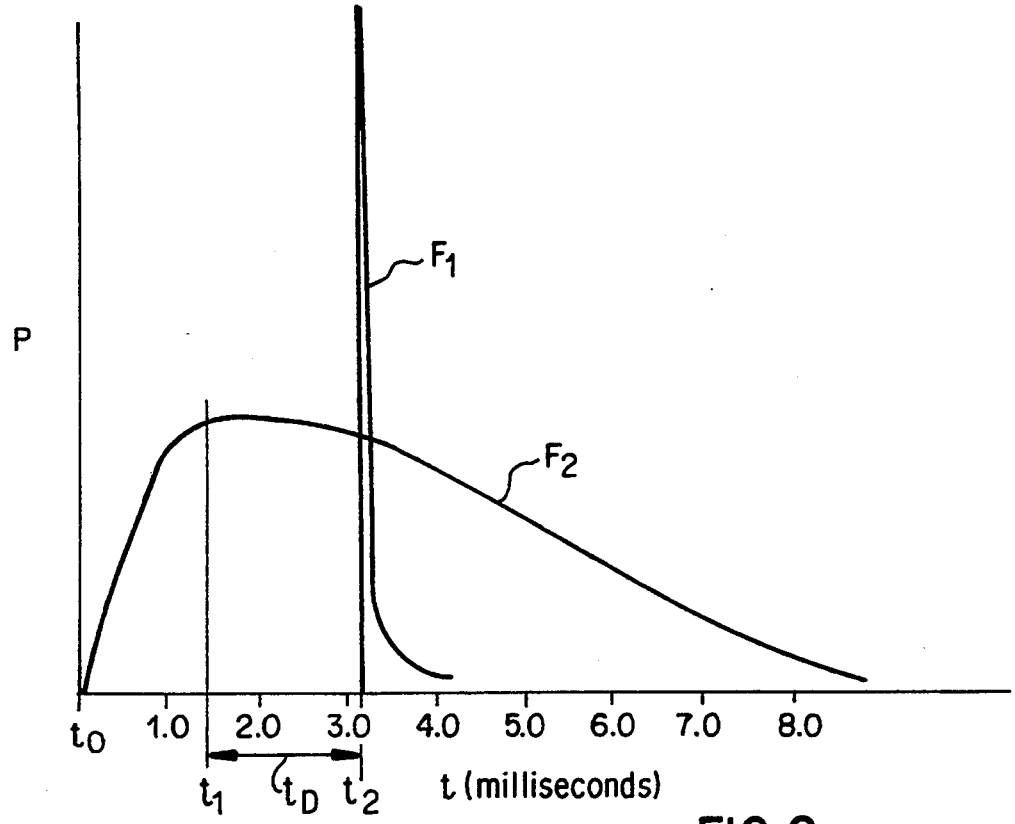
FIG. 2 is a diagram illustrating the pressures achieved by a gas propellant material and the shaped charges as a function of time in accordance with the present invention.

The operation of the present invention is represented in FIG. 2 by a pressure vs. time diagram similar to that used to illustrate the operation of the prior art of FIG. 1. However, in accordance with the operation of the present invention, a time delay $t_D$ is provided between time $t_1$, when the propellant reaches its peak pressure and time $t_2$, when the shaped charges are fired. At time $t_2$, an optimum pressure level occurs, just below the peak pressure reached in the borehole. The shaped charges are fired precisely at this optimum pressure level causing them to penetrate deeper into the formation than they would otherwise. The pressure provided by the propellant material continues after the shaped charges have been fired. This pressure propagates the fractures further into the formation surrounding the borehole than the prior art techniques without having to perform any additional operations.

One factor contributing to the greater fracture propagation, especially in a cased hole, is that the gas released from the propellant does not leak through a perforated portion of the casing until the shaped charges are detonated at time $t_2$. Therefore, perforation of the casing and penetration into the formation by the propellant material are part of a single, highly efficient operation.

Even where an uncased hole is under consideration, the pressure buildup associated with delaying the firing of the shaped charges until the propellant material has reached maximum pressure and receded a small amount, achieves far superior results to the prior art.

An additional feature of the invention is associated with firing the shaped charges through a gas zone. Gas is released prior to firing of the shaped charges from the propellant material, creating a gas zone around the tool. Gas provides much less friction than liquid. It is also more mobile than liquid resulting in faster pressurization of the perforation tunnel and within the fracture. These factors permit the shaped charges to penetrate deeper and faster helping to boost the efficiency of the fracturing and propagation technique. As a result, production from the well is increased.

As already mentioned, higher fracture speeds are associated with firing the shaped charges through high pressure gas. The purpose of achieving higher fracture speeds is to generate multiple fractures. These multiple fractures include fractures aligned perpendicular to the minimum in-situ stress (hydraulic type), as well as other fractures. If the fracture speed is fast, the orientation of each fracture is determined by the associated perforation direction. The non-hydraulic fractures generated by the invention can cross natural fractures in the formation. As the hydrocarbon flow depends strongly on the number of fractures intersected, the present invention significantly enhances the well productivity.

Figure 3:
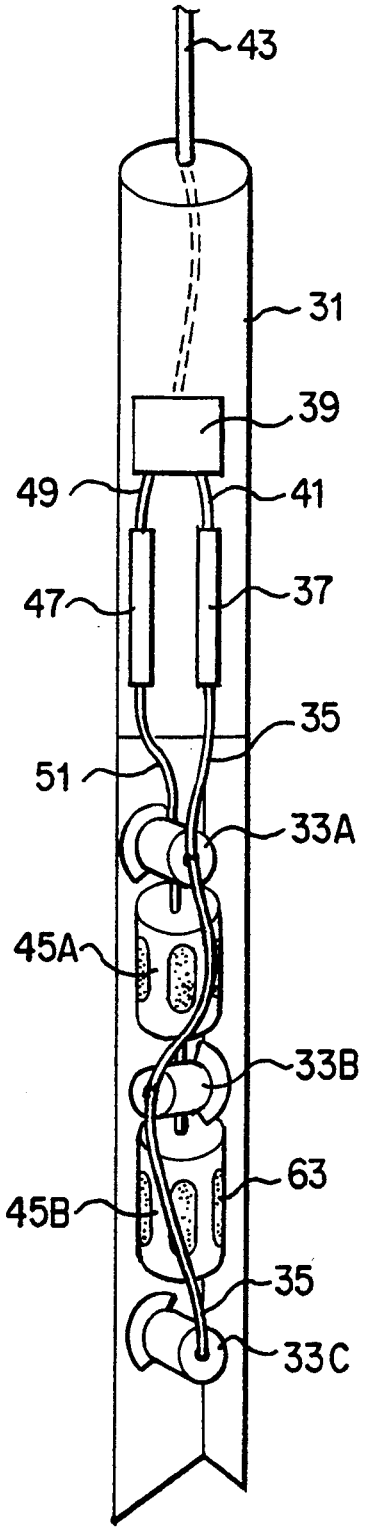
FIG. 3 shows the physical features and layout of a tool in accordance with the present invention.

FIG. 3 is a diagram illustrating the various components of a tool for perforating a casing and propagating a fracture in a formation behind the casing. A tool 31 includes a propellant loading system and a perforation charge assembly. The perforation charge assembly is responsible for firing shaped charges 33 after time delay, $t_D$. The assembly includes a detonator 37 connected to at least one oriented shaped charge 33 via a firing cord 35. Firing device 37 is activated by delay box 39 via a wire 41, to deliver an ignition signal on firing cord 35. As is customary in wireline tools, a cable 43 connects tool 31 to a surface apparatus including a sheave and winch (not shown) at the top of the borehole for delivering signals to and from tool 31 and for suspending tool 31 in the borehole at a particular depth.

The propellant loading system is responsible for pressurizing the wellbore by releasing a gas from at least one propellant generating cartridge 45. An ignitor 47 is connected to wireline cable 43 through delay box 39 via wires 49 and cord 51.

Figure 4:
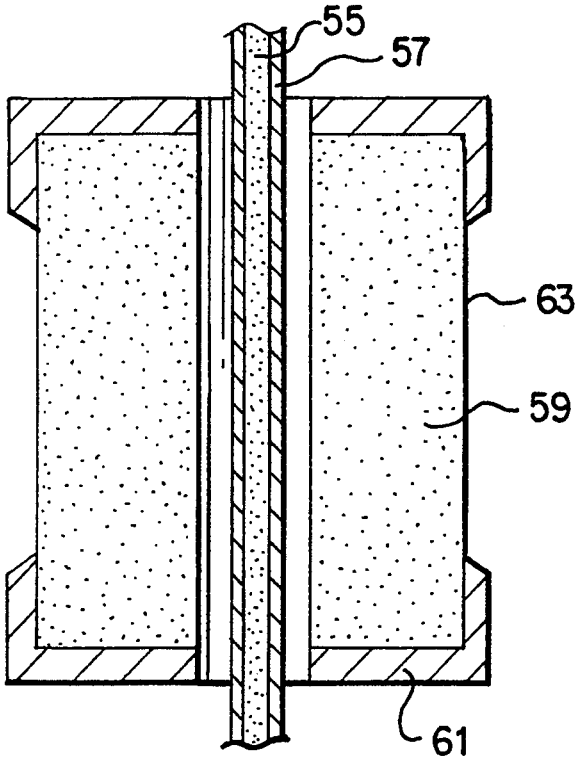
FIG. 4 is a more detailed view of a gas propellant generating cartridge shown in FIG. 3.

FIG. 4 is an illustration of an individual propellant generation cartridge 45. Propellant 59 is packed in a housing 61 having lateral openings 63 along its side panels. These lateral openings 63 permit the escape of combustion products which form the propellant charge. Preferably, propellant 59 is in contact with the fluid filling the borehole and is protected from degradation by the borehole fluid by being formed in a resin polymerized unit. Through the middle of each housing 61 of shaped charge 33 runs an ignition tube 65 filled with a fast burning material 55. This fast burning material 55 runs along the complete length of cord 51 from ignitor 47 to the final propellant generating cartridge 45 (In FIG. 3, this is cartridge 45B).

The operation of the invention will be described with reference to the figures. The role of delay box 39 is to transmit a first pulse at a time $t_0$ to ignitor 47 and a second pulse at time $t_1+t_D$ to firing device 37. These events are started upon receiving an appropriate signal from the operator on wireline cable 43. The first pulse provides ignition of cord 51, which in turn starts combustion of fast burning material 55 that fills ignition tube 57. The burning of material 55 in ignition tube 57 initiates the combustion of propellant material 59 which is a relatively slow burning material. As propellant material 59 burns, it releases gas into the borehole creating a gas zone around the tool and in the borehole at the level of the production zone. Pressure increases as shown by function $F_2$ of FIG. 2. After a maximum pressure is reached ($t_1$) and a short delay time has elapsed, a second pulse, transmitted at time $t_1+t(t_2)$, fires shaped charges 33 after propellant material 59 is nearly completely burned. At $t_2$, the pressure in the borehole is just below the maximum pressure ($t_1$) and is at an optimum level for perforation. The second pulse is as short as possible to avoid any significant propellant leakage from the production zone in which tool 31 is positioned.

The precise timing between ignition of propellant generation cartridges 48 and the firing of shaped charges 33 is critical to the invention. For maximum efficiency, this preselected time delay ($t_D$) should be at least 1 millisecond but no more than 100 milliseconds. This ensures that the pressure in the production zone has peaked and is just beginning to subside. In addition, a head of fluid of at least 100 meters above the tool position is important for tamping purposes. This head size ensures that there is no communication between the gas and the areas outside the production zone and has proved effective for maximizing pressure with minimal leakage of propellant fluid.

The design of shaped charges 33 must be such that they can be oriented in a particular direction. At the same time each shaped charge 33 must be focused so that upon being fired, it perforates the casing or the formation wall without damaging the casing or crushing the formation. For example, a high explosive such as that described by Godfrey et al. would be inappropriate because it could damage the casing.

In conclusion, the present invention achieves numerous advantages over the prior art. These include a greater pressure buildup resulting in deeper propagation of an original fracture in the formation in a borehole, greater fracture speed and lesser gas loss as propagation occurs. Also, efficiency of penetration is increased due to firing of the shaped charges through a gas zone. While the above is a complete description of the preferred embodiments of the invention, various alternatives, modifications and equivalents may be used. For example, the propellant generation cartridges 45 may include a gas propellant or an alternative fluid. Further, the optimum pressure levels for practicing the invention vary with depth, as well as other factors such as borehole diameter and the type of formation. One of ordinary skill in the art would recognize that these factors must be considered before selecting appropriate delay times and pressure levels. In addition, although the invention has only been discussed with respect to a wireline apparatus, it could easily be implemented in a conveyed tubing type device or any other type of borehole tool. Therefore, the above description should not be taken as limiting the scope of the invention which is defined by the appended claims.

What is claimed is:

1. A method for fracturing a formation surrounding a borehole, the method being performed by a fracture initiation and propagation tool and comprising the steps of:

positioning the tool in a production zone of the borehole;

igniting a gas propellant in the tool which is released to pressurize a portion of the borehole surrounding the production zone;

waiting a predetermined time period until the production zone of the borehole reaches a maximum pressure level and decreases a preselected amount; and firing at least one shaped charge through a gas zone created by the gas propellant to initiate a fracture at a particular location such that pressure built up by the gas propellant is released into the particular location propagating the fracture.

2. The method of claim 1 wherein a liquid head above the gas released from the tool is at least one hundred meters to prevent communication between the gas and areas outside the production zone.

3. The method of claim 1 wherein the preselected time period is at least one millisecond.

4. The method of claim 1 wherein the preselected time period is no more than 100 milliseconds.

5. The method of claim 1 wherein the shaped charges are fired after the propellant has burned.

6. A method for perforating a casing in a cased wellbore and propagating a fracture in a formation behind the casing, the method being performed by a perforation and propagation tool and comprising the steps of:

positioning the tool in a production zone of the wellbore;

igniting a propellant in the tool which releases a gas to pressurize a portion of the wellbore surrounding the production zone;

waiting a predetermined time period until the production zone of the wellbore reaches a maximum pressure level and decreases a preselected amount; and firing at least one shaped charge through a gas zone created by ignition of the propellant to perforate the casing and initiate a fracture at a particular location such that pressure built up by the gas is released into the particular location propagating the fracture.

7. The method of claim 6 wherein a liquid head above the gas released from the tool is at least one hundred meters to prevent communication between the gas and areas outside the production zone.

8. The method of claim 6 wherein the preselected time period is at least one millisecond.

9. The method of claim 6 wherein the preselected time period is no more than 100 milliseconds.

10. The method of claim 6 wherein the shaped charges are fired after the propellant has burned.

11. An apparatus for initiating and propagating a fracture in a formation surrounding a borehole, comprising:

means for positioning to a desired location in the borehole;

means for igniting a propellant in the tool which releases gas to pressurize a portion of the borehole surrounding the production zone;

means for waiting a predetermined time period until the production zone of the borehole reaches a maximum pressure level and decreases a preselected amount; and means for firing at least one shaped charge through a gas zone created by ignition of the propellant to initiate a fracture at a particular location such that pressure built up by the gas propellant is released into the particular location propagating the fracture.

12. An apparatus for perforating a casing in a production zone of a cased borehole and propagating a fracture behind casing, comprising:

at least one propellant generating cartridge for releasing a gas within the borehole;

at least one shaped charge for perforating the casing at a particular location and at a particular orientation in the production zone;

an ignitor for igniting the at least one propellant generating cartridge to release gas within the borehole for pressurizing the area of the borehole around the production zone;

firing means for firing the at least one shaped charge which perforates the casing at the particular location and at the particular orientation and initiates a fracture in the formation; and delay means connected to the ignitor and the firing means for receiving a signal to initiate operation of the ignitor and to provide a predetermined time period before initiating operation of the firing means such that the firing means is caused to operate after the gas released in the borehole reaches a maximum pressure level around the production zone and recedes a preselected amount.

13. The apparatus of claim 12 wherein a liquid head above the gas released from the tool is at least one hundred meters to prevent communication between the gas and areas outside the production zone.

14. The apparatus of claim 12 wherein the preselected time period is at least one millisecond.

15. The apparatus of claim 12 wherein the preselected time period is no more than 100 milliseconds.

16. The apparatus of claim 12 wherein the shaped charges are fired after the propellant has burned.

* * * * *